US009065210B2

(12) United States Patent
Narita

(10) Patent No.: US 9,065,210 B2
(45) Date of Patent: Jun. 23, 2015

(54) ELECTRICAL CONNECTOR

(71) Applicant: DAI-ICHI SEIKO CO., LTD., Kyoto-shi (JP)

(72) Inventor: Kenji Narita, Tokyo (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 62 days.

(21) Appl. No.: 13/855,958

(22) Filed: Apr. 3, 2013

(65) Prior Publication Data

US 2013/0273760 A1 Oct. 17, 2013

(30) Foreign Application Priority Data

Apr. 17, 2012 (JP) ..... 2012-093572

(51) Int. Cl.

*H01R 12/24* (2006.01)
*H01R 13/629* (2006.01)
*H01R 12/77* (2011.01)

(Continued)

(52) U.S. Cl.

CPC ..... *H01R 13/629* (2013.01); *H01R 12/774* (2013.01); *H01R 12/79* (2013.01); *H01R 12/87* (2013.01); *H01R 13/6271* (2013.01); *H01R 13/635* (2013.01)

(58) Field of Classification Search

CPC ..... H01R 23/7021
USPC ..... 439/327, 325, 328
See application file for complete search history.

(56) References Cited

U.S. PATENT DOCUMENTS 4,724,310 A * 2/1988 Shimamura et al. ..... 235/483
4,774,399 A * 9/1988 Fujita et al. ..... 235/441

(Continued)

FOREIGN PATENT DOCUMENTS

CN 102057539 A 5/2011
EP 0 750 372 A2 12/1996

(Continued)

OTHER PUBLICATIONS

Extended European Search Report issued Jul. 16, 2013 in Patent Application No. 13162826.5.

(Continued)

*Primary Examiner* — Neil Abrams
(74) *Attorney, Agent, or Firm* — Oblon, McClelland, Maier & Neustadt, L.L.P.

(57) ABSTRACT

An efficient removal operation of a signal transmission medium is enabled with a simple configuration. A lock mechanism having a latch lock part, which retains an inserted state of the signal transmission medium by engagement with the signal transmission medium inserted in an insulating housing, is provided with an unlock maintaining part, which retains the latch lock part at a detachment position in conjunction with an unlock operation. It is configured so that, when the latch lock part of the lock mechanism is to be detached from the signal transmission medium by the unlock operation, an unlock maintaining part, which is moved in conjunction with the unlock operation, causes the latch lock part to be retained in a state in which it is detached from the signal transmission medium, and the signal transmission medium is maintained in a removable state thereafter even without continuing the unlock operation so that the unlock operation is completed at first for example only with one hand, and the signal transmission medium can be removed thereafter.

2 Claims, 11 Drawing Sheets

(51) Int. Cl.

| | |
|---|---|
| ***H01R 12/79*** | (2011.01) |
| ***H01R 13/635*** | (2006.01) |
| *H01R 12/87* | (2011.01) |
| *H01R 13/627* | (2006.01) |

(56) References Cited

U.S. PATENT DOCUMENTS

| | | | | |
|---|---|---|---|---|
| 4,887,188 | A * | 12/1989 | Yoshida et al. | 361/679.31 |
| 4,931,622 | A * | 6/1990 | Ohtsuki et al. | 235/487 |
| 5,066,241 | A * | 11/1991 | Hills | 439/260 |
| 5,155,663 | A * | 10/1992 | Harase | 361/679.31 |
| 5,225,293 | A * | 7/1993 | Mitchell et al. | 429/97 |
| 5,305,180 | A * | 4/1994 | Mitchell et al. | 361/679.37 |
| 5,468,156 | A * | 11/1995 | Flinchbaugh et al. | 439/157 |
| 5,716,730 | A * | 2/1998 | Deguchi | 429/97 |
| 5,718,594 | A | 2/1998 | Tondreault et al. | |
| 5,777,316 | A * | 7/1998 | Horie et al. | 235/486 |
| 5,803,762 | A * | 9/1998 | Green | 439/347 |
| 5,812,370 | A * | 9/1998 | Moore et al. | 361/679.38 |
| 6,160,707 | A * | 12/2000 | Yin | 361/704 |
| 6,264,506 | B1 * | 7/2001 | Yasufuku et al. | 439/638 |
| 6,382,995 | B1 * | 5/2002 | Bricaud et al. | 439/159 |
| 6,398,567 | B1 * | 6/2002 | Nishimura | 439/159 |
| 6,438,229 | B1 * | 8/2002 | Overy et al. | 379/446 |
| 6,469,900 | B2 * | 10/2002 | Cheng | 361/726 |
| 6,643,139 | B2 * | 11/2003 | Tien | 361/727 |
| 6,757,172 | B2 * | 6/2004 | Maruyama | 361/737 |
| 6,942,514 | B1 * | 9/2005 | Cheng et al. | 439/328 |
| 6,960,093 | B1 * | 11/2005 | Fan | 439/326 |
| 7,018,227 | B2 * | 3/2006 | Takahashi | 439/347 |
| 7,357,655 | B1 * | 4/2008 | Van der Steen | 439/188 |
| 7,381,075 | B2 * | 6/2008 | Gontarek et al. | 439/341 |
| 7,510,424 | B2 * | 3/2009 | Mundt | 439/492 |
| 7,677,907 | B2 * | 3/2010 | Guan et al. | 439/157 |
| 7,850,473 | B1 * | 12/2010 | Ozeki | 439/260 |
| 7,887,942 | B2 * | 2/2011 | Rejman et al. | 429/97 |
| 7,903,152 | B2 * | 3/2011 | Kim | 348/231.99 |
| 8,002,567 | B2 * | 8/2011 | Hara | 439/329 |
| 8,056,813 | B2 * | 11/2011 | Long et al. | 235/486 |
| 8,235,740 | B2 * | 8/2012 | Tsai | 439/328 |
| 8,282,402 | B2 * | 10/2012 | Ngo | 439/79 |
| 8,282,409 | B2 * | 10/2012 | Ma | 439/328 |
| 8,360,485 | B2 * | 1/2013 | Ma et al. | 292/333 |
| 8,534,637 | B2 * | 9/2013 | Kuo | 248/500 |
| 8,608,509 | B2 * | 12/2013 | Shimada et al. | 439/607.01 |
| 8,834,190 | B2 * | 9/2014 | Ngo et al. | 439/328 |
| 2005/0245135 | A1 | 11/2005 | Fan | |
| 2011/0045681 | A1 | 2/2011 | Tsai | |
| 2011/0104936 | A1 | 5/2011 | Ozeki | |
| 2014/0179135 | A1 * | 6/2014 | Hsu | 439/152 |

FOREIGN PATENT DOCUMENTS

| | | | |
|---|---|---|---|
| EP | 2 251 937 | A1 | 11/2010 |
| JP | 2009-231069 | | 10/2009 |
| JP | 2010-27520 | A | 2/2010 |
| JP | 2011-108500 | | 6/2011 |
| JP | 2011-108501 | | 6/2011 |
| WO | WO 2012/008353 | A1 | 1/2012 |

OTHER PUBLICATIONS

Office Action issued Dec. 24, 2014 in Chinese Patent Application No. 201310112198.8.

* cited by examiner

ELECTRICAL CONNECTOR

BACKGROUND OF THE INVENTION

1. Field of the Invention

The present invention relates to an electrical connector provided with a lock mechanism that retains a signal transmission medium inserted into an insulating housing and provided with an unlock mechanism thereof.

2. Description of Related Art

Generally, in various electrical devices, etc., various electrical connectors are widely used as means for electrically connecting various signal transmission media such as flexible printed circuits (FPC) and flexible flat cables (FFC). For example, in an electrical connector mounted and used on a printed wiring board like Japanese Patent Application Laid-Open No. 2009-231069 described below, a signal transmission medium consisting of, for example, a FPC or FFC is inserted to the interior thereof from a front-end-side opening of an insulating housing (insulator), and an actuator (connection operating means) is then turned by operating force of an operator so as to be pushed down toward a connection action position in a connector front side or rear side. As a result, part of a lock member drops in an engagement part provided at a terminal part of the signal transmission medium to achieve an engaged state, and the terminal part of the signal transmission medium is configured to be retained in an approximately immobile state by the lock member.

In this manner, the electrical connector provided with the actuator is configured to operate engagement/detachment of the lock member by subjecting the actuator to a turning operation between a connection cancel position and a connection action position; wherein, operation efficiency may be problematic since the actuator has to be operated separately from the operation of inserting the signal transmission medium (for example, FPC, FFC). Therefore, conventionally, an electrical connector provided with a so-called one-action auto-lock mechanism is sometimes employed, wherein the mechanism is configured so that part of the lock member is elastically displaced so as to be placed over the signal transmission medium inserted in the insulating housing and that part of the lock member then drops in an engagement part of the signal transmission medium to carry out engagement. When an electrical connector provided with such a one-action auto-lock mechanism is used, the signal transmission medium can be retained in an approximately immobile state only by inserting the signal transmission medium to a predetermined position in the electrical connector, wherein operation efficiency is improved.

However, although the one-action auto-lock mechanism employed in conventional electrical connectors has an advantage that locking and retention is carried out only by inserting the signal transmission medium (for example, FPC, FFC) into the electrical connector as described above, when an unlock operation for removing the signal transmission medium from the insulating housing is to be carried out, while carrying out the unlock operation with one hand, an operation of removing the signal transmission medium with the other hand in parallel with the unlock operation has to be carried out. The unlock operation takes labor, and the operation of removing the signal transmission medium cannot be efficiently carried out in some cases.

We disclose the prior art that we are aware of to be materials for the examination of the application as follows.

[Unexamined Publication Gazette 1] JP 2009-231069 A

[Unexamined Publication Gazette 2] JP 2011-108500 A

[Unexamined Publication Gazette 3] JP 2011-108501 A

BRIEF SUMMARY OF THE INVENTION

Therefore, it is an object of the present invention to provide an electrical connector that enables an efficient removal operation of a signal transmission medium consisting of, for example, FPC or FFC with a simple configuration.

In order to achieve the above described object, the present invention employs a configuration of an electrical connector having a lock mechanism having a latch lock part that is engaged with part of a signal transmission medium inserted in an insulating housing and retains an inserted state of the signal transmission medium and an unlock mechanism that causes the signal transmission medium to be removable from the insulating housing by an unlock operation of moving the latch lock part of the lock mechanism from an engagement position to a detachment position with respect to the signal transmission medium; wherein the unlock mechanism is provided with an unlock maintaining part that maintains the latch lock part at the detachment position in conjunction with the unlock operation.

According to the present invention having such a configuration, when the latch lock part of the lock mechanism is to be detached from the signal transmission medium by the unlock operation, the unlock maintaining part, which is moved in conjunction with the unlock operation, causes the latch lock part to be maintained in a state in which it is detached from the signal transmission medium. Therefore, thereafter, the signal transmission medium is maintained in a removable state even without continuing the unlock operation; and the unlock operation can be completed at first for example with one hand, and the signal transmission medium can be removed thereafter.

Herein, in the present invention, it is possible that the lock mechanism has a lock biasing member that retains the latch lock part at the engagement position with respect to the signal transmission medium and an unlock operating part that moves the latch lock part to the detachment position against the lock biasing member; the unlock maintaining part has an unlock maintaining nail that is moved to a position at which the nail abuts the signal transmission medium in conjunction with the unlock operation; and the unlock maintaining nail is configured to be brought into contact with the signal transmission medium with a pressure by biasing force of the lock biasing member so as to retain the latch lock part at the detachment position.

In the present invention, it is possible that the lock biasing member has first and second elastic arm-shaped members that are elastically displaced in two directions, the two directions being in planes approximately orthogonal to an insertion direction of the signal transmission medium and being approximately orthogonal to each other. It is desirable that the first elastic arm-shaped member of the lock biasing member in this case is disposed to be elastically displaceable along a board-thickness direction of the signal transmission medium, and the second elastic arm-shaped member of the lock biasing member is disposed to be elastically displaceable along a board-width direction of the signal transmission medium.

According to the present invention having such a configuration, the lock mechanism and the unlock operation mechanism can be configured to be mutually shared, and the whole electrical connector has a simple configuration.

As described above, in the electrical connector according to the present invention, a lock mechanism having a latch lock part, which retains an inserted state of the signal transmission medium by engagement with the signal transmission medium inserted in an insulating housing, is provided with an unlock maintaining part, which retains the latch lock part at a detachment position in conjunction with an unlock operation. It is configured so that, when the latch lock part of the lock mechanism is to be detached from the signal transmission medium by the unlock operation, an unlock maintaining part, which is moved in conjunction with the unlock operation, causes the latch lock part to be retained in a state in which it is detached from the signal transmission medium, and the signal transmission medium is maintained in a removable state thereafter even without continuing the unlock operation so that the unlock operation is completed at first for example only with one hand, and the signal transmission medium can be removed thereafter. Therefore, a removable operation of the signal transmission medium consisting of, for example, a FPC or FFC can be efficiently carried out with a simple configuration, and reliability of the electrical connector can be significantly improved at low cost.

DETAILED DESCRIPTION OF THE INVENTION

Figure 1:
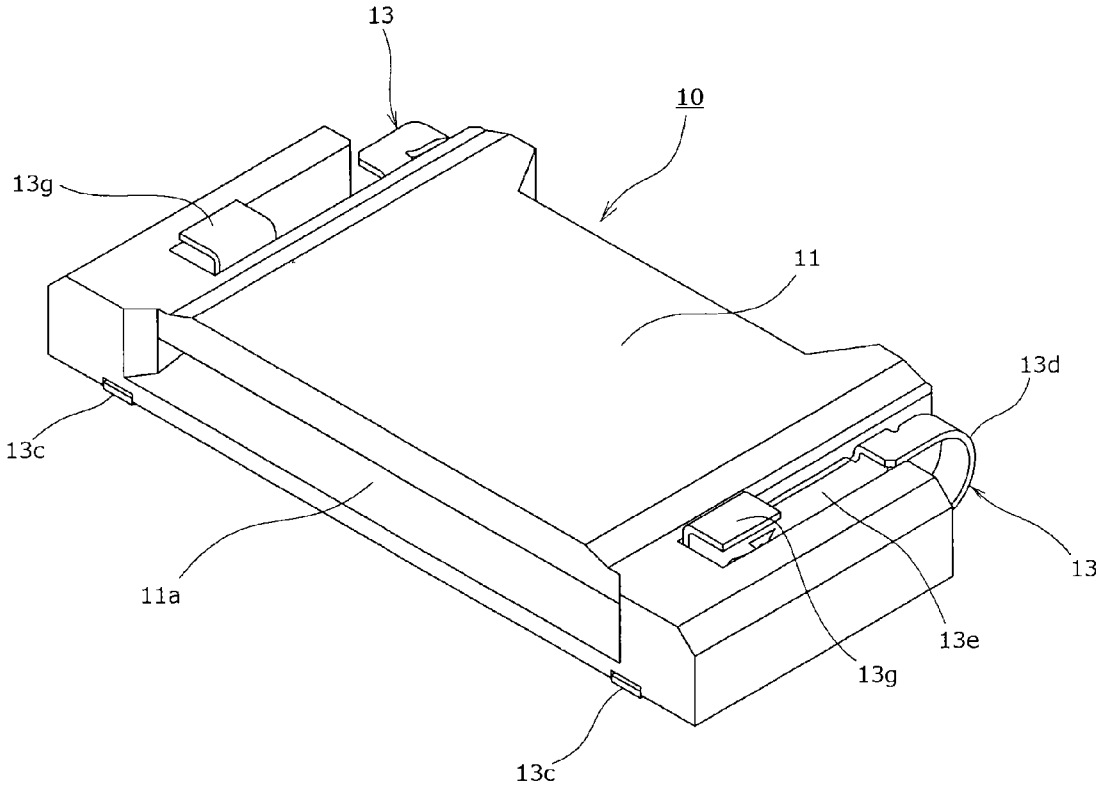
FIG. 1 is an explanatory external perspective view showing an electrical connector according to an embodiment of the present invention from a front upper side.
Figure 2:
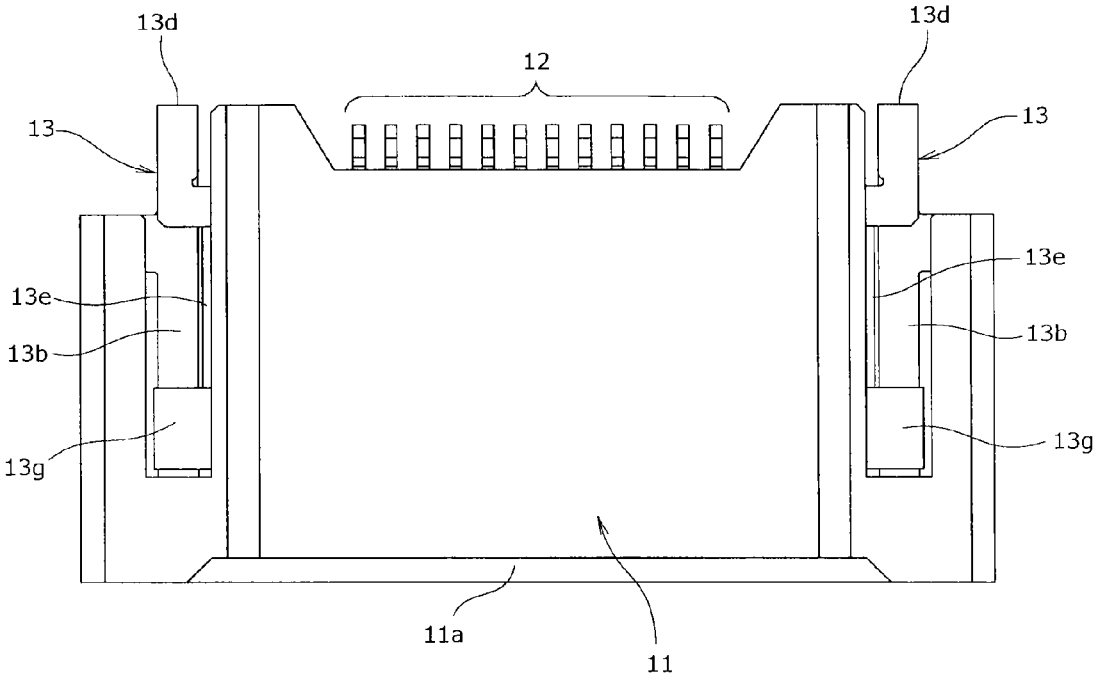
FIG. 2 is an explanatory plan view of the electrical connector shown in FIG. 1.
Figure 3:
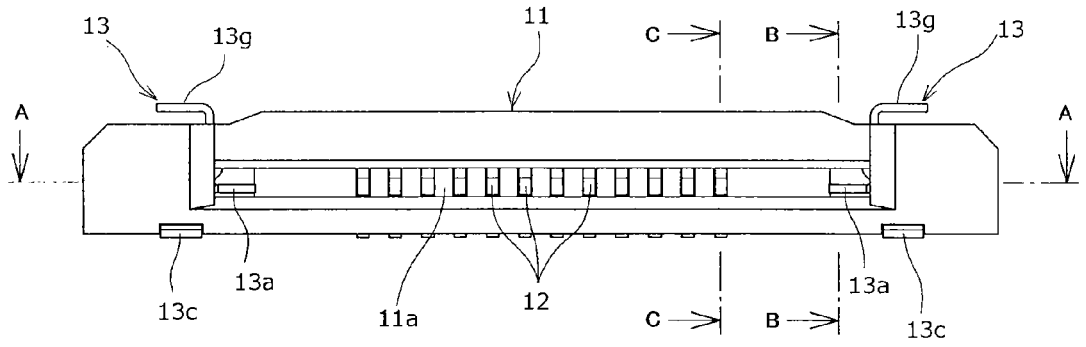
FIG. 3 is an explanatory front view of the electrical connector shown in FIG. 1 and FIG. 2.

Hereinafter, an embodiment in which the present invention is applied to an electrical connector, which is to be mounted and used on a wiring board in order to establish connection of a signal transmission medium consisting of a flexible printed circuit (FPC), a flexible flat cable (FFC), or the like, will be explained in detail based on drawings.

[About Overall Configuration of Electrical Connector]

The electrical connector 10 according to the embodiment of the present invention shown in FIG. 1 to FIG. 16 consists of an electrical connector provided with a one-action auto-lock mechanism of a so-called NON-ZIF type, wherein, when a terminal part of the above described signal transmission medium (for example, FPC or FFC) F is inserted to a predetermined position in the insulating housing 11, the signal transmission medium F is configured to be automatically locked.

[About Insulating Housing]

The above described insulating housing 11 is formed of a hollow insulating member, which is extending so as to form a shape of a narrow long flat plate. The longitudinal width direction of the insulating housing 11 will be hereinafter referred to as "connector longitudinal direction", the upstream side in the direction of inserting the terminal part of the signal transmission medium (for example, FPC or FFC) F will be referred to as "connector front side", and the downstream side thereof will be referred to as "connector rear side".

A front edge part (right edge part in FIG. 4) of the insulating housing 11 is provided with a medium insertion opening 11*a*, into which the terminal part of the signal transmission medium F consisting of, for example, a flexible printed circuit (FPC) or a flexible flat cable (FFC) as described above is to be inserted, so that the medium insertion opening forms a narrow long shape along the connector longitudinal direction. A hollow medium insertion path into which the signal transmission medium F is to be inserted is extending in the insulating housing 11 from the medium insertion opening 11*a* toward the connector rear side.

A connector-rear-side edge part (left edge part in FIG. 5) in the opposite side of the above described medium insertion opening 11*a* is provided with a part attachment opening for attaching later-described electrically-conductive contacts 12, etc. so that the part attachment opening similarly forms a narrow long shape along the connector longitudinal direction. Furthermore, in both-side outer parts in the connector longitudinal direction with respect to the above described medium insertion opening 11*a*, lock members 13, which constitute a later-described lock mechanism and unlock mechanism, are inserted from the connector rear side toward the front side (right side in FIG. 4).

[About Electrically-Conductive Contacts]

The plurality of electrically-conductive contacts 12 inserted in the insulating housing 11 in the above described manner are disposed to be multipolar with appropriate intervals therebetween in the connector longitudinal direction, and the electrically-conductive contacts 12 are formed of thin-plate-shaped metal members having mutually the same shapes. The electrically-conductive contacts 12 are attached so as to be inserted in the medium insertion path from the part attachment opening, which is provided in the rear end side of the insulating housing 11, toward the connector front side in the above described manner. Fixing base parts 12*a* provided at insertion-direction rear-end parts of the electrically-conductive contacts 12 are fixed by being press-fitted to an inner wall part of the connector rear end side of the insulating housing 11.

Each of the electrically-conductive contacts 12 is used as either for signal transmission or for ground connection in a state in which the electrically-conductive contact is mounted by solder joint with an electrically-conductive path formed on a main printed wiring board (illustration omitted). Therefore, the disposed positions of the electrically-conductive contacts 12 attached in the insulating housing 11 in the above described manner are set to correspond to a wiring pattern provided on the signal transmission medium (for example, FPC or FFC) F, which is to be inserted in the insulating housing 11 through the medium insertion opening 11*a*. The wiring pattern of the signal transmission medium F is signal-transmission electrically-conductive paths (signal-line pads) or shielded electrically-conductive paths (shielded line pads) disposed at appropriate pitch intervals.

The configuration of each of the electrically-conductive contacts 12 will be explained in detail. First, a board connecting part 12*a* 1 is formed at a lower end part of the fixing base part 12*a*, which is press-fitted in the connector rear-end-side part of the insulating housing 11 in the above described manner; and the board connecting part 12*a* 1 is configured to be connected by soldering to the electrically-conductive path formed on the main printed wiring board (illustration omitted).

Figure 5:
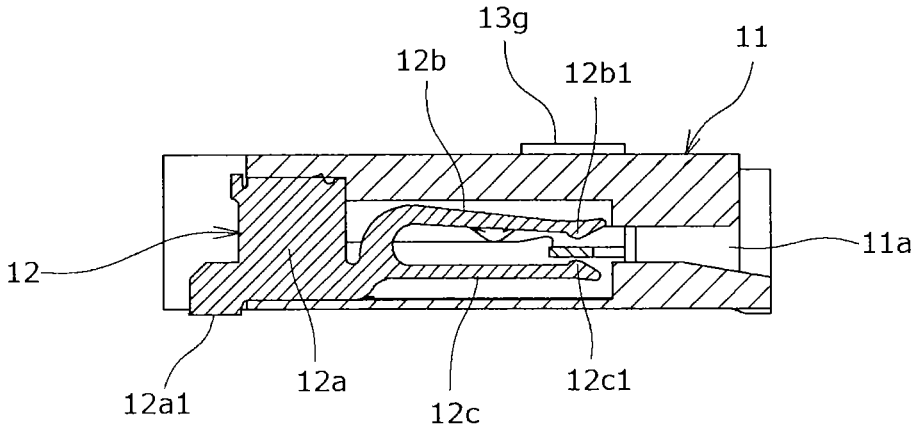
FIG. 5 is an explanatory vertical cross-sectional view along a line C-C in FIG. 3.

Furthermore, a pair of movable beams 12*b* and 12*c* is extended so as to be divided into to upper and lower two branches from the above described fixing base part 12*a* toward the connector front side (right side in FIG. 5). Both of these beams 12*b* and 12*c* are formed so as to be integrally extended from the fixing base part 12*a* in the connector rear end side to form cantilever shapes, and the movable beams 12*b* and 12*c* are extended so as to be along upper/lower inner wall surfaces, which form the medium insertion path of the insulating housing 11, in a state in which both of the movable beams 12*b* and 12*c* are separated to the upper side and the lower side. Extended-side (right side in FIG. 5) distal-end parts of both of the movable beams 12*b* and 12*c* of the electrically-conductive contact 12 having such a configuration are configured to swing in the upper/lower directions in the paper surface of FIG. 5 about the part of the coupling part between both of the movable beams 12*b* and 12*c* continued to the fixing base part 12*a* or about the vicinity thereof.

Furthermore, end parts (right-end-side parts in FIG. 5) of both of the movable beams 12*b* and 12*c* extended toward the connector front side are provided with terminal contact projecting parts 12*b* 1 and 12*c* 1 corresponding to the signal-transmission electrically-conductive path or the shielded electrically-conductive path (wiring pattern) formed on the signal transmission medium (for example, FPC or FFC) F so that the terminal contact projecting parts 12*b* 1 and 12*c* 1 form downward and upward protruding shapes so as to be opposed thereto upward/downward. More specifically, the terminal contact projecting parts 12*b* 1 and 12*c* 1 provided respectively on the movable beams 12*b* and 12*c* are in an arrangement relation by which, when the signal transmission medium F is inserted in the insulating housing 11 in the above described manner, the terminal contact projecting parts 12*b* 1 and 12*c* 1 are placed over the surfaces of the wiring patterns of the signal transmission medium F and sandwich the medium from the upper and lower sides; and the terminal contact projecting parts 12*b* 1 and 12*c* 1 are configured to be maintained in an electrically connected state since both of them are brought into contact therewith with pressures by the elastic force of both of the movable beams 12*b* and 12*c* when the signal transmission medium F is inserted to a predetermined final position (engagement position).

[About One-Action Auto-Lock Mechanism]

Figure 13:
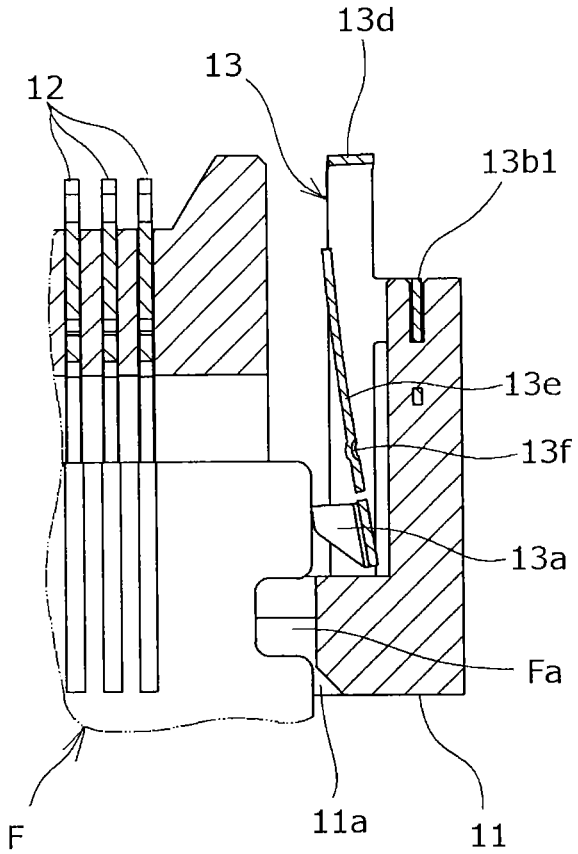
FIG. 13 is an explanatory horizontal transverse-cross-sectional view corresponding to FIG. 12 showing an insertion started state of the signal transmission medium.
Figure 14:
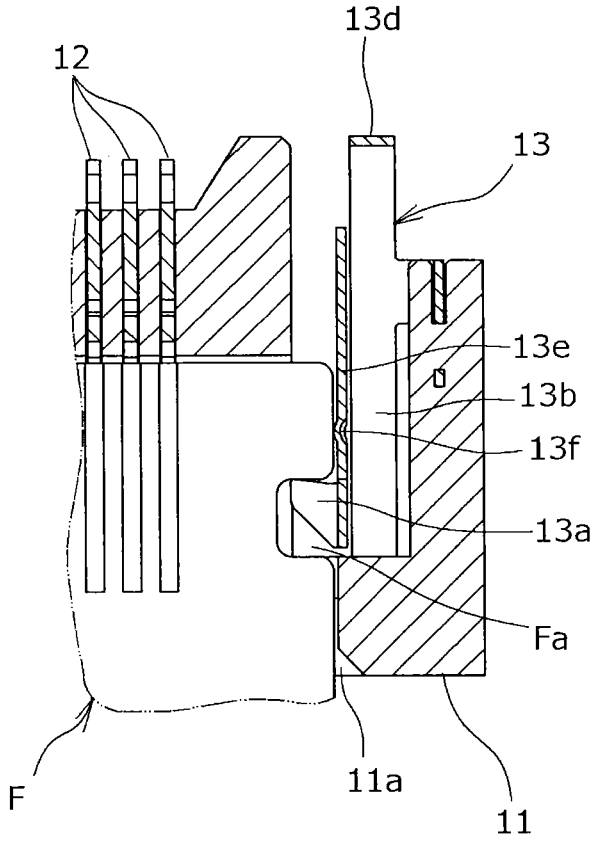
FIG. 14 is an explanatory horizontal transverse-cross-sectional view corresponding to FIG. 12 showing an insertion completed state in which the signal transmission medium is inserted from the state of FIG. 13 to an engagement position.
Figure 15:
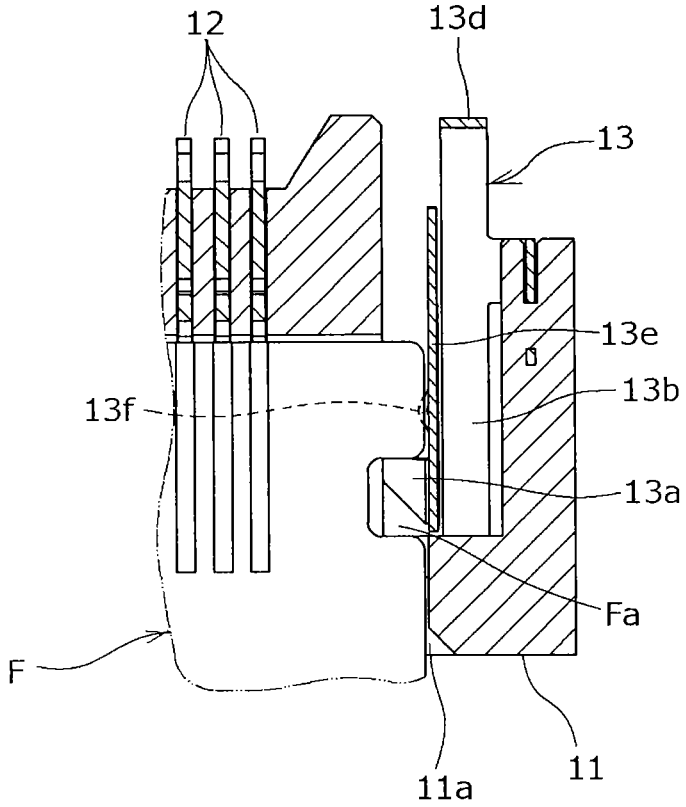
FIG. 15 is an explanatory horizontal transverse-cross-sectional view corresponding to FIG. 12, wherein a state in which an unlock operation is carried out from the state of FIG. 14 is shown.
Figure 16:
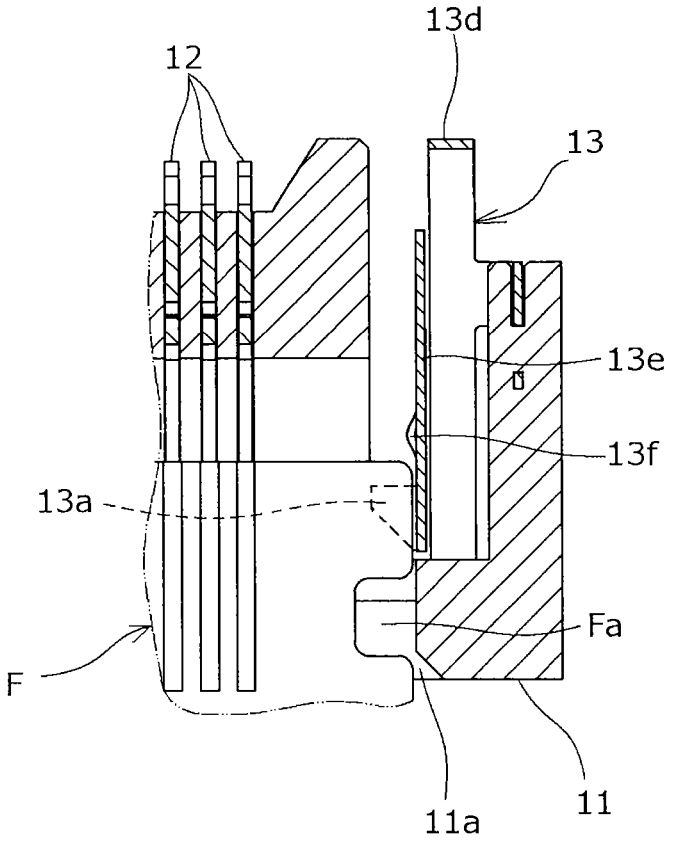
FIG. 16 is an explanatory horizontal transverse-cross-sectional view corresponding to FIG. 12, wherein an intermediate state of removal of the signal transmission medium from the state of FIG. 15 is shown.

The electrical connector 10 according to the present embodiment is provided with a one-action auto-lock mechanism as described above. As a condition thereof, particularly as shown in FIG. 13 and FIG. 14, in a terminal part of the signal transmission medium (for example, FPC or FFC) F, engagement position determining parts Fa consisting of cut-away recessed parts are formed respectively at edge parts in both sides of the board-width direction (connector longitudinal direction) of the signal transmission medium F. Corresponding to the engagement position determining parts Fa provided on the signal transmission medium F, the lock members 13, which constitute the lock mechanism and the unlock mechanism, are attached to connector-longitudinal-direction both-side parts in the electrical connector 10 side. An inserted state of the signal transmission medium F is configured to be retained by a latching action (locking action) of latch lock parts 13*a* provided in the lock members 13 thereof.

[About Lock Members]

The lock members 13 disposed at the connector-longitudinal-direction both-side parts of the insulating housing 11 in the above described manner constitute the locking mechanism and the unlocking mechanism for the signal transmission medium (for example, FPC or FFC) F. When the signal transmission medium F is inserted into the electrical connector 10, the insertion-side distal edge of the signal transmission medium F abuts part of the lock members 13, more specifically, later-described latch lock parts 13*a*, thereby causing the latch lock parts 13*a* to retract toward the outer sides in the connector longitudinal direction (see FIG. 13). At that point, second elastic arm-shaped members 13*e* serving as later-described lock biasing members supporting the latch lock parts 13*a* become a state that they are horizontally elastically displaced toward the outer sides of the longitudinal direction, and the elastic force of each of the second elastic arm-shaped members 13*e* causes the latch lock part 13*a* to move as if the latch lock part drops toward the interior of the engagement position determining part Fa of the signal transmission medium F to achieve an engaged state (locked state).

Both of the lock members 13, 13 disposed in both sides of the connector longitudinal direction have mutually symmetrical structures in the connector longitudinal direction. Therefore, in the below explanation, only one of the lock members 13 will be explained.

Figure 6:
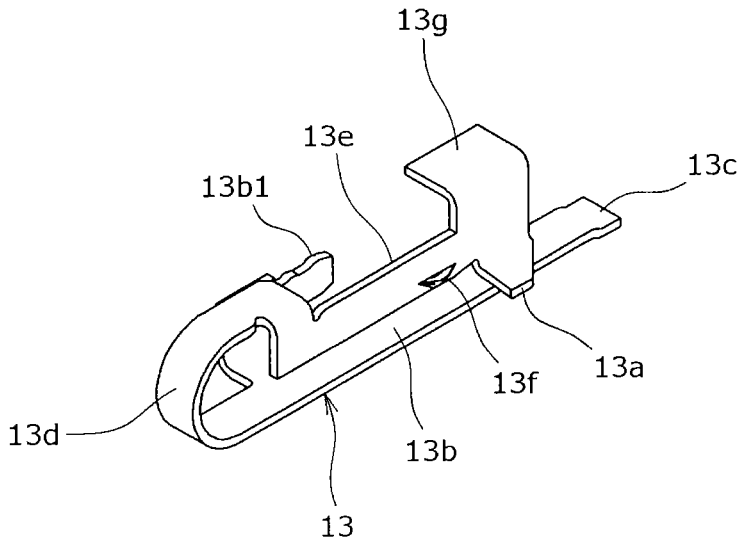
FIG. 6 is an explanatory external perspective view showing a lock member, which is used in the electrical connector shown in FIG. 1 to FIG. 5, from an upper inner side (connector center side) of a connector longitudinal direction.
Figure 7:
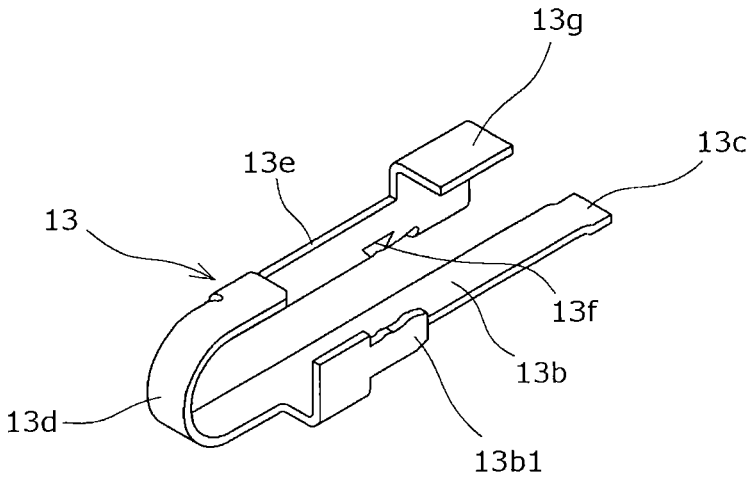
FIG. 7 is an explanatory external perspective view showing the lock member, which is used in the electrical connector shown in FIG. 1 to FIG. 5, from an outer upper side of the connector longitudinal direction.

Particularly as shown in FIG. 6 and FIG. 7, each of the lock members 13 is formed so as to form an integrated bent structure consisting of a metal member having a thin band-plate-like shape. A board connecting part 13*c*, a first elastic arm-shaped member 13*d*, the second elastic arm-shaped member 13*e*, an unlock maintaining nail 13*f*, the latch lock part 13*a*, and an unlock operating part 13*g* are integrally formed with a fixing board 13*b* disposed in the bottom surface side of the insulating housing 11 and having a narrow long flat plate shape.

More specifically, the above described fixing board 13*b* is disposed so as to be extended like a thin long belt along the connector front-rear direction at a position corresponding to a bottom surface plate of the insulating housing 11, and the fixing board 13*b* is fixed to a lateral surface plate of the insulating housing 11 via a fixing piece 13*b* 1, which is projecting toward the outer side of the connector longitudinal direction from a one-side edge of a front part of the fixing board 13*b*.

The board connecting part 13*c* is integrally continued to a front-side edge part (right side in FIG. 4) of the fixing board 13*b*. The board connecting part 13*c* is approximately horizontally extended from the front end side (right side in FIG. 4) of the fixing board 13*b* to the connector front side via a downward step part. In a state in which the board connecting part 13*c* is placed on the main wiring board (illustration omitted), the board connecting part 13*c* is configured to be joined therewith by soldering.

Furthermore, the first elastic arm-shaped member 13*d* constituting part of the lock biasing member is continued to a rear-end-side part (left-end-side part in FIG. 4) of the above described fixing board 13*b* so as to be curved and rise upward from the fixing board 13*b*. The first elastic arm-shaped member 13*d* is formed so as to have an approximately U-shape in a lateral face and have a bent shape, which is reversed to the connector rear side; and the first elastic arm-shaped member 13*d* is integrally extended in a cantilever shape so as to be extended approximately parallel at a position above the above described fixing board 13*b*.

The first elastic arm-shaped member 13*d* is set so that the board-width direction thereof is the connector longitudinal direction (horizontal direction) and the board-thickness direction is the vertical direction; and the first elastic arm-shaped member 13*d* is configured to be elastically displaced mainly in the vertical direction which is the thin board-thickness direction. The first elastic arm-shaped member 13*d* of the cantilever structure having such a bent shape is configured to swing in the vertical direction about the bent shape thereof or the vicinity thereof. The latch lock part 13*a*, which will be described later, is configured to be reciprocated in the vertical direction in the paper surface of FIG. 4 along with elastic displacement of the first elastic arm-shaped member 13*d*.

Figure 4:
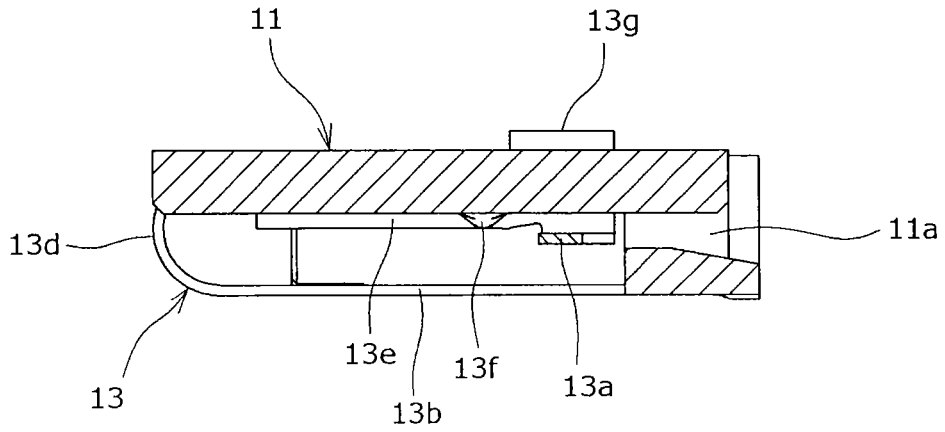
FIG. 4 is an explanatory vertical cross-sectional view along a line B-B in FIG. 3.

On the other hand, the second elastic arm-shaped member 13*e* is integrally extended from an extended-side end part of the above described first elastic arm-shaped member 13*d* toward the connector front side (right side in FIG. 4). The second elastic arm-shaped member 13*e* and the above described first elastic arm-shaped member 13*d* are in a mutually coupled relation in which the board-width directions thereof are approximately orthogonal to each other. More specifically, the board-thickness direction of the second elastic arm-shaped member 13*e* is set to be the connector longitudinal direction (horizontal direction), and the board-width direction thereof is set to be the vertical direction; therefore, the second elastic arm-shaped member 13*e* is configured to be elastically displaced mainly in the connector longitudinal direction (horizontal direction), which is the thin board-thickness direction. The second elastic arm-shaped member 13*e* having such a cantilever structure is configured to swing in the connector longitudinal direction (horizontal direction) about the part coupled to the above described first elastic arm-shaped member 13*d* or the vicinity thereof. The latch lock part 13*a*, which will be described later, is configured to reciprocate in the direction perpendicular to the paper surface of FIG. 4 along with elastic displacement of the second elastic arm-shaped member 13*e*.

In this manner, in the present embodiment, the first elastic arm-shaped member 13*d* and the second elastic arm-shaped member 13*e* serving as the lock biasing member are configured to be elastically displaced in the two directions, which are in the planes approximately orthogonal to the insertion direction of the signal transmission medium (for example, FPC or FFC) F and are approximately orthogonal to each other. At an extended-side end part (right-side end part in FIG. 4) of the second elastic arm-shaped member 13*e*, the above described latch lock part 13*a* and the unlock operating part 13*g* are integrally formed, and the unlock maintaining nail 13*f* is integrally formed at a part somewhat close to the connector rear side with respect to both of the members 13*a* and 13*g*.

The latch lock part 13*a* therein consists of a hook-shaped member projecting from the extended-end part (right edge part in FIG. 4) of the above described second elastic arm-shaped member 13*e* to the connector inner side (connector center side), and the latch lock part 13*a* is formed from a plate-shaped member having an approximately trapezoidal shape in a plane, the plate-shaped member formed by bending a lower edge part of the second elastic arm-shaped member 13*e* at an approximately right angle. The latch lock parts 13*a* are disposed at both-end parts of the elongated direction (connector longitudinal direction) of the medium insertion path into which the signal transmission medium (for example, FPC or FFC) F is to be inserted, and the latch lock parts 13*a* are provided so as to be projected or retracted with respect to the medium insertion path extended from the medium insertion opening 11*a*.

An inclined guiding side, which is to face the signal transmission medium (for example, FPC or FFC) F to be inserted in the medium insertion path, is formed at a front edge part of the latch lock part 13*a*. The insertion-side distal-edge part of the signal transmission medium F inserted in the medium insertion path has a positional relation by which the insertion-side distal-edge part abuts the inclined guiding side of the latch lock part 13*a*. Particularly as shown in FIG. 13, it is configured so that, when the signal transmission medium F abuts the inclined guiding side of the latch lock part 13*a*, horizontal component force generated at the inclined guiding side of the latch lock part 13*a* causes the entirety of the latch lock part 13*a* to be pushed away to the outer side of the connector longitudinal direction against the elastic force of the second elastic arm-shaped member 13*e*.

Furthermore, particularly as shown in FIG. 14, it is configured so that, when the engagement position determining part Fa provided in the signal transmission medium F reaches a position opposed to an immediate lateral of the latch lock part 13*a*, the latch lock part 13*a* is forcibly moved toward the interior of the engagement position determining part Fa by the elastic force of the above described second elastic arm-shaped member 13*e*, thereby causing the members Fa and 13*a* to be in a mutually engaged state (locked state). The engagement force of the latch lock part 13*a* in the engaged state is configured to maintain the inserted state of the signal transmission medium F.

On the other hand, the unlock operating part 13*g* is integrally formed with an upper edge part of the second elastic arm-shaped member 13*e*. More specifically, the unlock operating part 13*g* is formed from a plate-shaped member having an approximately rectangular shape in a plane, which is formed by extending a front end part (right end part in FIG. 4) of the second elastic arm-shaped member 13*e* to the upper side by a predetermined distance and then bending the part toward the connector outer side at an approximately right angle. It is configured so that, when this unlock operating part 13*g* is pressed downward to carry out an unlock operation, the above described first elastic arm-shaped member 13*d* is elastically displaced so as to be bent downward, the latch lock part 13*a* disposed at a position immediately below the unlock operating part 13*g* is moved to be pressed downward.

Next, the unlock maintaining nail 13*f* is disposed at a position somewhat away from the above described latch lock part 13*a* to the connector rear side, and the unlock maintaining nail 13*f* is formed by causing part of the second elastic arm-shaped member 13*e* to project toward the connector inner side, i.e., toward the signal transmission medium (for example, FPC or FFC) F side. The unlock maintaining nail 13*f* is formed so as to have an approximately arc-shaped outer-diameter shape in both of a planar view and a lateral view and is disposed at a position somewhat in the upper side with respect to the above described latch lock part 13*a*.

In more detail, a bottom surface part and a lateral surface part of the above described unlock maintaining nail 13*f* are formed to be curved so as to have an approximately arc-shaped outer-diameter shape, and the position of a top part of the arc-shaped bottom surface of the unlock maintaining nail 13*f* is set so as to be at a position above the upper surface position of the latch lock part 13*a* by about half of the thickness size of the signal transmission medium (for example, FPC or FFC) F.

A flat-surface part of the unlock maintaining nail 13*f* is formed so as to have an outer-diameter shape which is approximately arc shaped in a lateral face. The flat-surface parts of the unlock maintaining nails 13*f* are in an arrangement relation in which they are overlapped with both-side edge parts of the signal transmission medium (for example, FPC or FFC) F in a planar view.

When the signal transmission medium (for example, FPC or FFC) F is inserted into the electrical connector 10, the insertion-side distal-end part of the signal transmission medium F causes the latch lock part 13*a* to retract to the connector outer side in the above described manner (see FIG. 13); then, as shown in FIG. 14, when the engagement position determining part Fa provided in the signal transmission medium F reaches the position opposed to the immediate lateral of the latch lock part 13*a*, the latch lock part 13*a* is forcibly moved toward the interior of the engagement position determining part Fa by the elastic force of the above described second arm-shaped member 13*e*, thereby causing the members Fa and 13*a* to be in a mutually engaged state (locked state).

Figure 10:
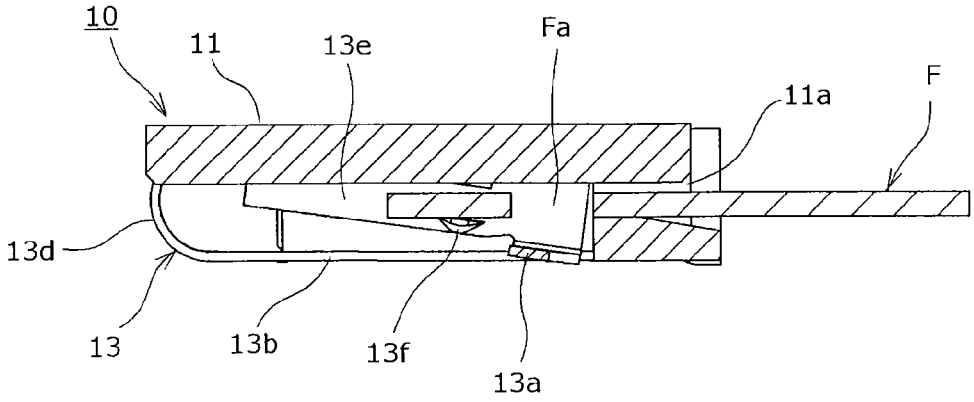
FIG. 10 is an explanatory vertical cross-sectional view corresponding to FIG. 4, wherein a state in which an unlock operation is carried out in the state of FIG. 9 is shown.
Figure 11:
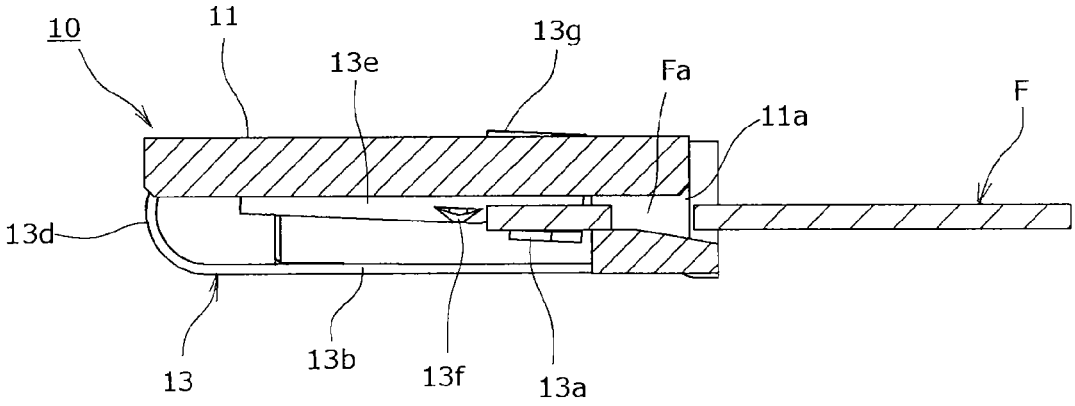
FIG. 11 is an explanatory vertical cross-sectional view corresponding to FIG. 4, wherein an intermediate state of removing the signal transmission medium from the state of FIG. 9 is shown.
Figure 12:
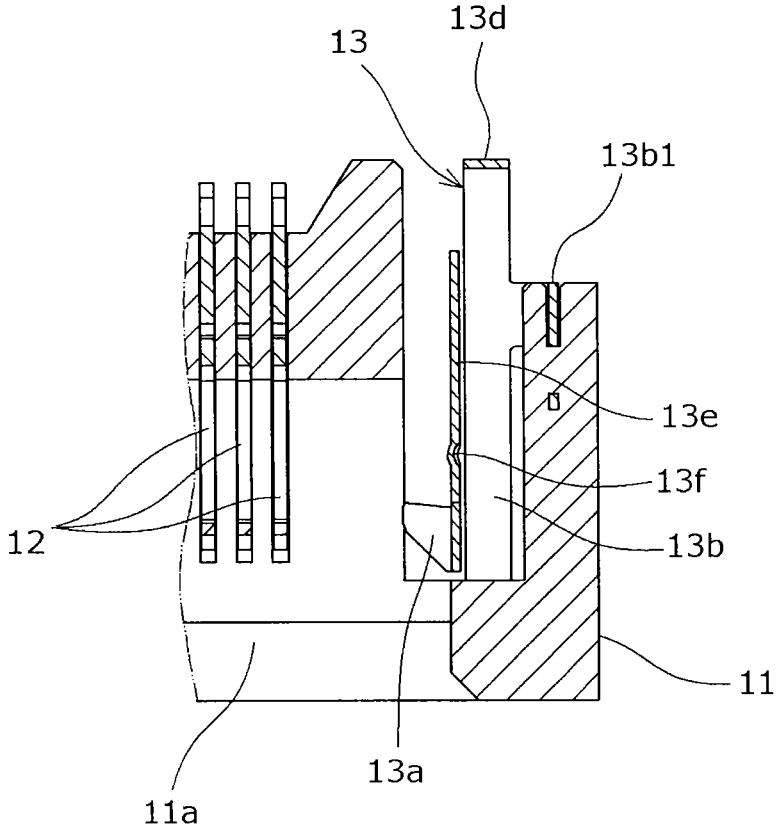
FIG. 12 is an explanatory horizontal transverse-cross-sectional view showing one-side end part in a cross section along a line A-A in FIG. 3.

On the other hand, when an unlock operation of pressing the unlock operating part 13*g* downward against the elastic force of the first elastic arm-shaped member 13*d* is carried out for example as shown in FIG. 10 in the engaged state in which the signal transmission medium (for example, FPC or FFC) F is inserted in the electrical connector 10 as described above, the unlock maintaining nail 13*f* is moved downward together with the latch lock part 13*a*. The downward movement of the unlock maintaining nail 13*f* in this process is carried out from the upper surface to the lower surface of the signal transmission medium F; wherein, in an intermediate state thereof, the arc-shaped lateral surface of the unlock maintaining nail 13*f* slides while in contact with a lateral end surface of the signal transmission medium F with a pressure. In that process, the second elastic arm-shaped member 13*e* is once elastically deformed so as to be opened to the connector outer side by the amount of the projecting distance of the unlock maintaining nail 13*f*; and, when the unlock maintaining nail 13*f* reaches the lower surface position of the signal transmission medium F, the unlock maintaining nail 13*f* is returned to the original position in the connector inner side by the elastic force of the second elastic arm-shaped member 13*e*.

As a result, the approximately arc-shaped flat-surface part of the unlock maintaining nail 13*f* becomes a state in which the part is in contact with the lower surface of the signal transmission medium (for example, FPC or FFC) F from the lower side (see FIG. 10). The latch lock part 13*a* at that point is in a positional relation in which the part is detached from the engagement position determining part Fa of the signal transmission medium F to the lower side to become an unengaged state, wherein the signal transmission medium F can be removed. Then, when the unlock operating part 13*g* is released in the state in which the latch lock part 13*a* is in a detached position as described above, the unlock maintaining nail 13*f* and the latch lock part 13*a* try to return to original upper positions because of the elastic force of the first elastic arm-shaped member 13*d*; however, as described above, the unlock maintaining nail 13*f* is maintained in a state in which the nail is in contact with the lower surface of the signal transmission medium F with a pressure, and the latch lock part 13*a* is maintained at a detached position with respect to the signal transmission medium F. Therefore, an operator can remove the signal transmission medium F in a state in which a hand is not in contact with the unlock operating part 13*g*.

Figure 8:
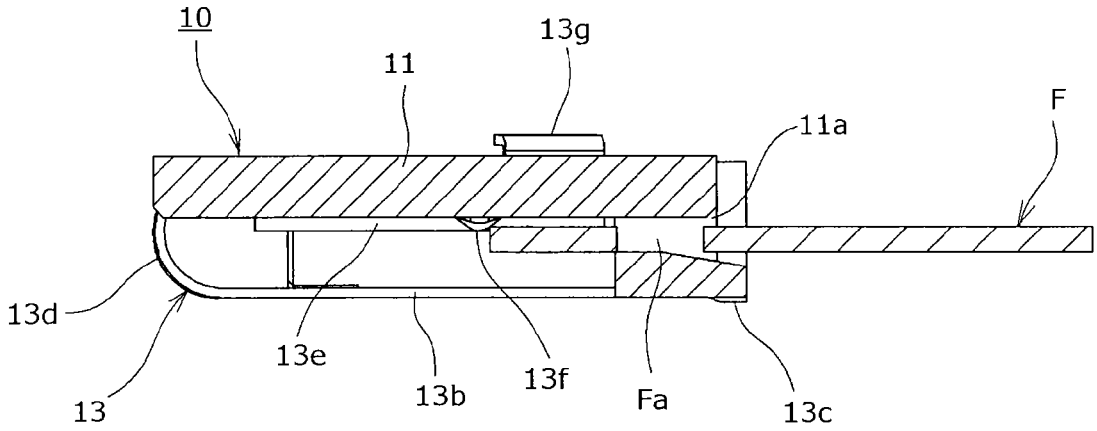
FIG. 8 is an explanatory vertical cross-sectional view corresponding to FIG. 4, wherein an insertion started state of the signal transmission medium with respect to the electrical connector shown in FIG. 1 to FIG. 5 is shown.
Figure 9:
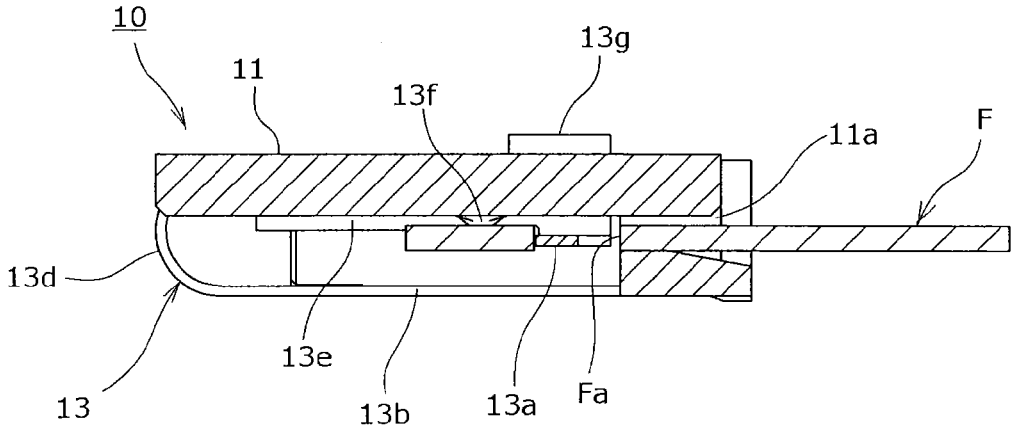
FIG. 9 is an explanatory vertical cross-sectional view corresponding to FIG. 4, wherein an insertion completed state in which the signal transmission medium is inserted from the state of FIG. 8 to an engagement position is shown.

The state of engagement/disengagement from insertion of the signal transmission medium (for example, FPC or FFC) F will be explained in detail. First, as shown in FIG. 8 and FIG. 13, when the signal transmission medium F is inserted into the insulating housing 11 through the medium insertion opening 11*a* of the insulating housing 11, the insertion-side distal edge part of the signal transmission medium F abuts the inclined guiding surface of the latch lock part 13*a* provided in the lock member 13, and the latch lock part 13*a* is retracted and moved so as to be pushed away to the outer side of the board-width direction of the signal transmission medium F against the elastic force of the second elastic arm-shaped member 13*e*. Furthermore, when the terminal part of the signal transmission medium F is pushed in toward the connector rear side from that state, the latch lock part 13*a* slides while in contact with the lateral edge of the signal transmission medium F; and, when the engagement position determining part Fa is moved to the position immediately lateral to the latch lock part 13*a*, the latch lock part 13*a* is moved so as to be pushed into the engagement position determining part Fa of the signal transmission medium F by the elastic recovery force of the second elastic arm-shaped member 13*e* as shown in FIG. 9 and FIG. 14. As a result, the latch lock part 13*a* becomes an engaged state with respect to the engagement position determining part Fa of the signal transmission medium F, and the signal transmission medium F is retained so as not to be removed therefrom.

When the unlock operating part 13*g* is pressed downward against the elastic force of the first elastic arm-shaped member 13*d* to carry out an unlock operation as shown in FIG. 10 in a state in which the signal transmission medium (for example, FPC or FFC) F has been caused to be in the engaged state (locked state) by the latch lock part 13*a* of the lock member 13 to retain the signal transmission medium F, the latch lock part 13*a* is also moved downward, the latch lock part 13*a* is detached from the engagement position determining part Fa of the signal transmission medium F, and the engaged state (locked state) is cancelled.

Then, when the unlock operating part 13*g* is operated to detach the latch lock part 13*a* of the lock mechanism from the signal transmission medium (for example, FPC or FFC) F in the above described manner, the unlock maintaining nail 13*f* is moved to from the position above the signal transmission medium F to a position therebelow along with the unlock operation via the unlock operating part 13*g*, the unlock maintaining nail 13*f* becomes a state in which it is in contact with the signal transmission medium F with a pressure, thereby maintaining the latch lock part 13*a* in a state detached from the signal transmission medium F. Thereafter, even when the unlock operating part 13*g* is not kept being operated, the signal transmission medium F is maintained in a removable state; and, for example by operation with only one hand, the operation of the unlock operating part 13*g* can be completed at first, and the signal transmission medium F can be then removed.

In this process, in the present embodiment, the first elastic arm-shaped member 13*d* constituting the lock biasing member, which retains the latch lock part 13*a* of the lock mechanism, is configured to be shared as an elastic member which retains the unlock operating part 13*g* of the unlock operating mechanism, and the lock mechanism and the unlock operating mechanism are configured to be mutually shared. Therefore, the whole electrical connector has a simple configuration.

Hereinabove, the invention accomplished by the present inventor has been explained in detail based on the embodiment. However, the present invention is not limited to the above described embodiment, and it goes without saying that various modifications can be made within a range not departing from the gist thereof.

For example, in the above described embodiment, the flexible printed circuit (FPC) and the flexible flat cable (FFC) are employed as signal transmission media to be fixed to the electrical connector. However, the present invention can be similarly applied to a case in which other signal transmission media, etc. are used.

Furthermore, the electrically-conductive contacts having the same shape are used in the electrical connector according to the above described embodiment. However, the present invention can be similarly applied even to a structure in which electrically-conductive contacts having different shapes are alternately disposed.

The present invention can be applied widely to various electrical connectors used in various electrical equipment.

What is claimed is:

1. An electrical connector comprising a lock mechanism having a latch lock part that is engaged with part of a signal transmission medium inserted in an insulating housing and retains an inserted state of the signal transmission medium; and an unlock mechanism that causes the signal transmission medium to be removable from the insulating housing by an unlock operation of moving the latch lock part of the lock mechanism from an engagement position to a detachment position with respect to the signal transmission medium, wherein the unlock mechanism is provided with an unlock maintaining part that maintains the latch lock part at the detachment position in conjunction with the unlock operation, the lock mechanism has a lock biasing member that retains the latch lock part at the engagement position with respect to the signal transmission medium, and unlock operating part that moves the latch lock part to the detachment position against the lock biasing member, the unlock maintaining part has an unlock maintaining nail that is moved to a position at which the nail abuts the signal transmission medium in conjunction with the unlock operation, the unlock maintaining nail is configured to be brought into contact with the signal transmission medium with a pressure by biasing force of the lock biasing member so as to retain the latch lock part at the detachment position, and the lock biasing member has first and second elastic arm-shaped members that are elastically displaced in two directions, the two directions being in planes approximately orthogonal to an insertion direction of the signal transmission medium and being approximately orthogonal to each other.

2. The electrical connector according to claim 1, wherein the first elastic arm-shaped member of the lock biasing member is disposed to be elastically displaceable along a board-thickness direction of the signal transmission medium, and the second elastic arm-shaped member of the lock biasing member is disposed to be elastically displaceable along a board-width direction of the signal transmission medium.

* * * * *